US007002596B1

(12) United States Patent
Soohoo

(10) Patent No.: US 7,002,596 B1
(45) Date of Patent: Feb. 21, 2006

(54) ANTI-ALIASING SYSTEM AND METHOD

(75) Inventor: Kenneth Soohoo, Redwood Shores, CA (US)

(73) Assignee: Planetweb, Inc., Mountain View, CA (US)

( * ) Notice: Subject to any disclaimer, the term of this patent is extended or adjusted under 35 U.S.C. 154(b) by 734 days.

(21) Appl. No.: 09/261,081

(22) Filed: Mar. 2, 1999

(51) Int. Cl.
*G09G 5/00* (2006.01)

(52) U.S. Cl. ..... 345/611

(58) Field of Classification Search ..... 345/132, 345/136, 470, 141; 382/298, 299, 300
See application file for complete search history.

(56) References Cited

U.S. PATENT DOCUMENTS

| | | | | |
|---|---|---|---|---|
| 4,785,391 A | | 11/1988 | Apley et al. | 364/518 |
| 5,390,289 A | | 2/1995 | Beitel et al. | 395/100 |
| 5,537,131 A | | 7/1996 | Mitsuhashi et al. | 345/128 |
| 5,555,360 A | * | 9/1996 | Kumazaki et al. | 345/443 |
| 5,565,886 A | * | 10/1996 | Gibson | 345/136 |
| 5,638,503 A | | 6/1997 | Hoel | 395/142 |
| 5,680,488 A | | 10/1997 | Shimooku | 382/298 |
| 5,719,595 A | * | 2/1998 | Hoddie et al. | 345/136 |
| 5,940,080 A | * | 8/1999 | Ruehle et al. | 345/432 |
| 6,208,319 B1 | * | 3/2001 | Nishida | 345/1 |

FOREIGN PATENT DOCUMENTS

| | | |
|---|---|---|
| EP | 0 428 356 A2 | 5/1991 |
| EP | 0 654 778 A1 | 5/1995 |
| EP | 0 786 757 A1 | 7/1997 |

OTHER PUBLICATIONS

Thomas W. Phinney, "TrueType & PostScript Type 1: What's the Difference?", p. 1 (http://www.truetype.demon.co.uk/articles/ttvst1.htm), printed Jan. 4, 2001.
Print Communications (PrintComm), "Fast Facts Electronic Publishing Articles," Article #1, (Part 1 of 2): True Type or Adobe Type 1? and (Part 2 of 2): True Type Font Issues? (http://www.comm.media.state.mn.us/printing/ElecPubArt.htm), printed Jan. 4, 2001.

* cited by examiner

*Primary Examiner*—Amr A. Awad
*Assistant Examiner*—Motilewa Good-Johnson
(74) *Attorney, Agent, or Firm*—Wilson Sonsini Goodrich & Rosati

(57) ABSTRACT

A method of displaying a character. A representation of a character is determined in a bit map having a number of bits greater than a number of pixels in a region of a display in which the character is to be displayed. Based on a relative number of bits that are on in respective portions of the bit map, luminances for corresponding pixels are determined. The character is displayed in the region having the particular number of pixels, and the pixels are displayed with the determined luminances. A system for displaying a character is disclosed, in which the character is to be displayed within a region of a display having a particular number of pixels. According to various embodiments of the invention, the display comprises a television, a color television, a display of a hand held device, a billboard, or other display device. A method for displaying a shape is described. A method of displaying a shape is disclosed. A television system and a computer program product are disclosed. According to one embodiment of the invention, logic, based on a relative number of bits that are on in respective portions of the bit map, determines an attribute for corresponding pixels. The attribute may comprise luminance, saturation, hue, or other attribute.

1 Claim, 10 Drawing Sheets

146

140

Column 142

| Row 144 | 1 | 2 | 3 | 4 | 5 | 6 |
|---|---|---|---|---|---|---|
| 1 | | | 50% | 50% | | |
| 2 | | | 100% | 100% | | |
| 3 | | 25% | 25% | 25% | 25% | |
| 4 | | 50% | 50% | 50% | 50% | |
| 5 | | 100% | | | 100% | |
| 6 | 75% | 25% | | | 25% | 75% |

Figure 1C

ANTI-ALIASING SYSTEM AND METHOD

BACKGROUND

1. Field of the Invention

The invention relates to graphical display, in particular to anti-aliasing for graphical display.

2. Description of Related Art

In graphical user interfaces, shapes are typically displayed as a combination of pixels. Shapes may include text or graphics. A pixel is typically a portion of a display that has a hue, saturation, and luminance value at any particular point in time. Images of text or graphics are created as combinations of pixels throughout the display. A shape to be displayed may in some cases only imperfectly be rendered as a combination of pixels. For example, where a mathematical representation of the shape has a curved edge, pixels in the set of pixels used to render the shape may have edges that do not exactly correspond to the edge of the shape. Thus, in such an example, an imperfect rendering of the mathematical shape occurs. In particular, as characters of text are displayed on a display in a size that is small relative to the size of pixels, imperfections may occur.

One attempt to correct for such imperfections is a technique known as anti-aliasing. Under some anti-aliasing techniques, intensity of a pixel may be adjusted where an edge of the corresponding shape does not correspond to an edge of a pixel. U.S. Pat. No. 5,390,289, entitled "Anti-Alias Font Generation," which is incorporated herein by reference, describes one technique of anti-aliasing for font generation.

SUMMARY OF THE INVENTION

An embodiment of the invention includes a method of displaying a character. A representation of a character is determined in a bit map having a number of bits greater than a number of pixels in a region of a display in which the character is to be displayed. Based on a relative number of bits that are on in respective portions of the bit map, luminances for corresponding pixels are determined. The character is displayed in the region having the particular number of pixels, and the pixels are displayed with the determined luminances.

In one embodiment of the invention, determining a representation of the character in a bit map includes generating the bit map based on a vector representation of the character. In various embodiments of the invention, the number of bits in the bit map is at least twice as great, at least four times as great, and at least ten times as great as the number of pixels in the region.

According to one embodiment of the invention, the vector representation of the character comprises an Adobe™ character. According to another embodiment of the invention, the vector representation of the character comprises an Adobe Type 1™ character.

An embodiment of the invention includes a system for displaying a character, and the character is to be displayed within a region of a display having a particular number of pixels. The system includes logic that renders a bit map corresponding to a vector representation of the character. Logic included in the system causes the logic that renders to render a bit map having a number of bits greater than the particular number of pixels. Logic, based on a relative number of bits that are on in respective portions of the bit map, determines luminances for corresponding pixels. Further logic causes the character to be displayed in the region having the particular number of pixels. The pixels are displayed on the display in response to the determined luminances.

According to various embodiments of the invention, the display comprises a television, a color television, a display of a hand held device, a billboard, or other display device.

An embodiment of the invention includes a method for displaying a shape. The shape is to be displayed a particular size on a display. A bit map rendering of the shape is requested in which the shape has a size larger than the particular size. Based on the bit map, luminances are determined for corresponding pixels of a rendering of the shape on the display having the particular size. The shape is displayed on the display in the particular size with the pixels having the determined luminances.

An embodiment of the invention includes a television system. Another embodiment of the invention includes a computer program product.

According to one embodiment of the invention, logic, based on a relative number of bits that are on in respective portions of the bit map, determines an attribute for corresponding pixels. Logic causes the character to be displayed in the region having the particular number of pixels, and the pixels are displayed on the display in response to the determined attributes. According to various embodiments of the invention, the attribute comprises hue, saturation, or luminance.

BRIEF DESCRIPTION OF THE DRAWINGS

The invention is illustrated by way of example, and not limitation in the drawings.

FIGS. 1A–1D show a character being rendered for display on a display system.

DETAILED DESCRIPTION

The following is a description of embodiments of the invention. The embodiments shown help to illustrate the invention. However, it is not intended that the invention be limited to the precise embodiments shown.

In one example of the invention, a shape is rendered on a display as a set of pixels. The luminance of the pixels is determined based on a bit map having a size larger than the size the shape is to be displayed on the display. A shape is rendered in the bit map as various bits in the bit map are either on or off, thus representing whether some portion of the shape is in that part of the bit map. A certain number of bits in the bit map correspond to one pixel. The luminance of the corresponding pixel is determined based on the percentage of bits in the bit map that are on. Thus, the luminance of the pixel helps to represent the extent to which the shape covers the portion of the bit map corresponding to the pixel.

Thus, where a shape is simply represented as a series of pixels that are either on or off, a rendered shape may not appear as a it is intended. Adjusting luminances helps cause the shape appears more accurate, even where the number of pixels may be relatively low. Using a bit map to determine luminances has the advantage of allowing for relatively fast calculation of the luminance. Less CPU power may be used by the system. Also, using such a method to anti-alias a font for display of a character, less storage space may be required because use can be avoided of bit map fonts that are already anti-aliased. According to an embodiment of the invention, either bit map fonts or outline fonts may be rendered.

Figure 1A:
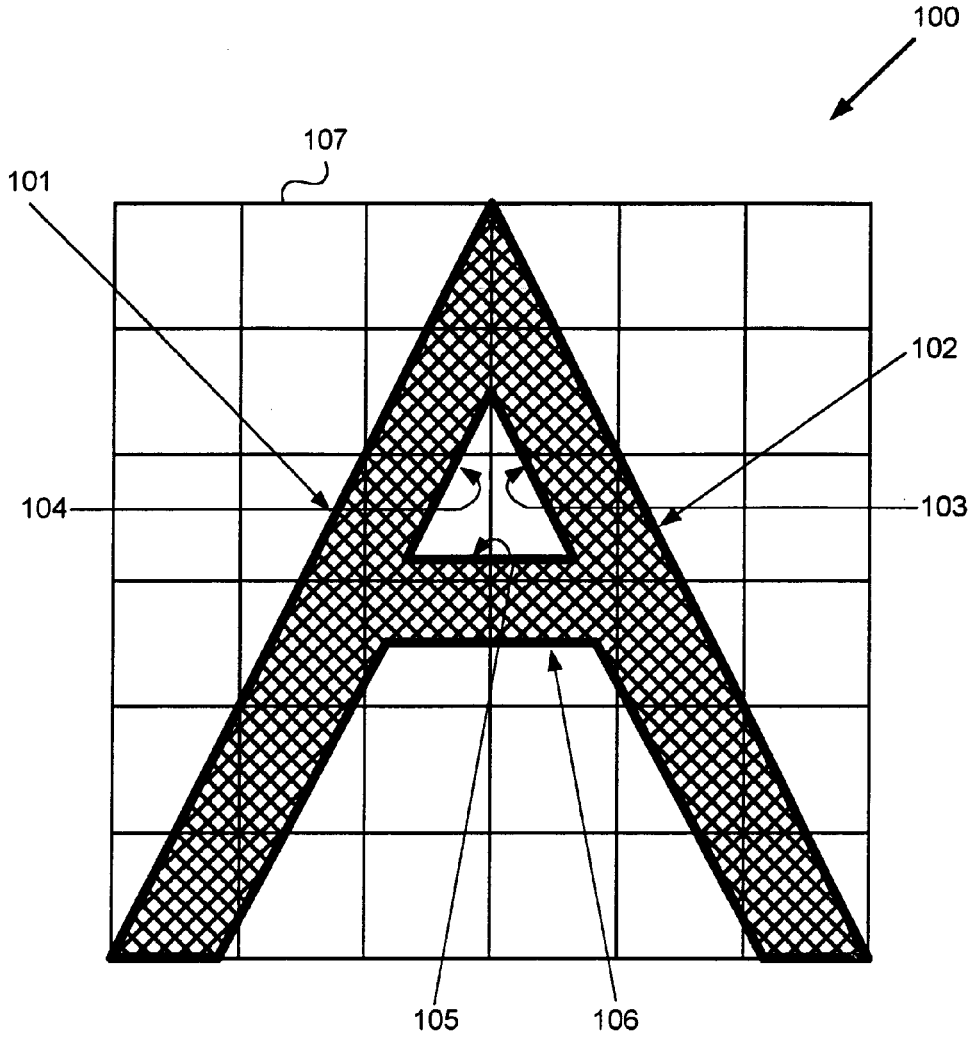

FIGS. 1A–1D show a character being rendered for display on a display system. FIG. 1A shows a depiction of a character 100 according to its ideal shape. Character 100 is bordered by sides including 101, 102, 103, 104, 105, and 106. As shown here, it is depicted true to shape without regard to underlying pixels in grid 107.

Figure 1B:
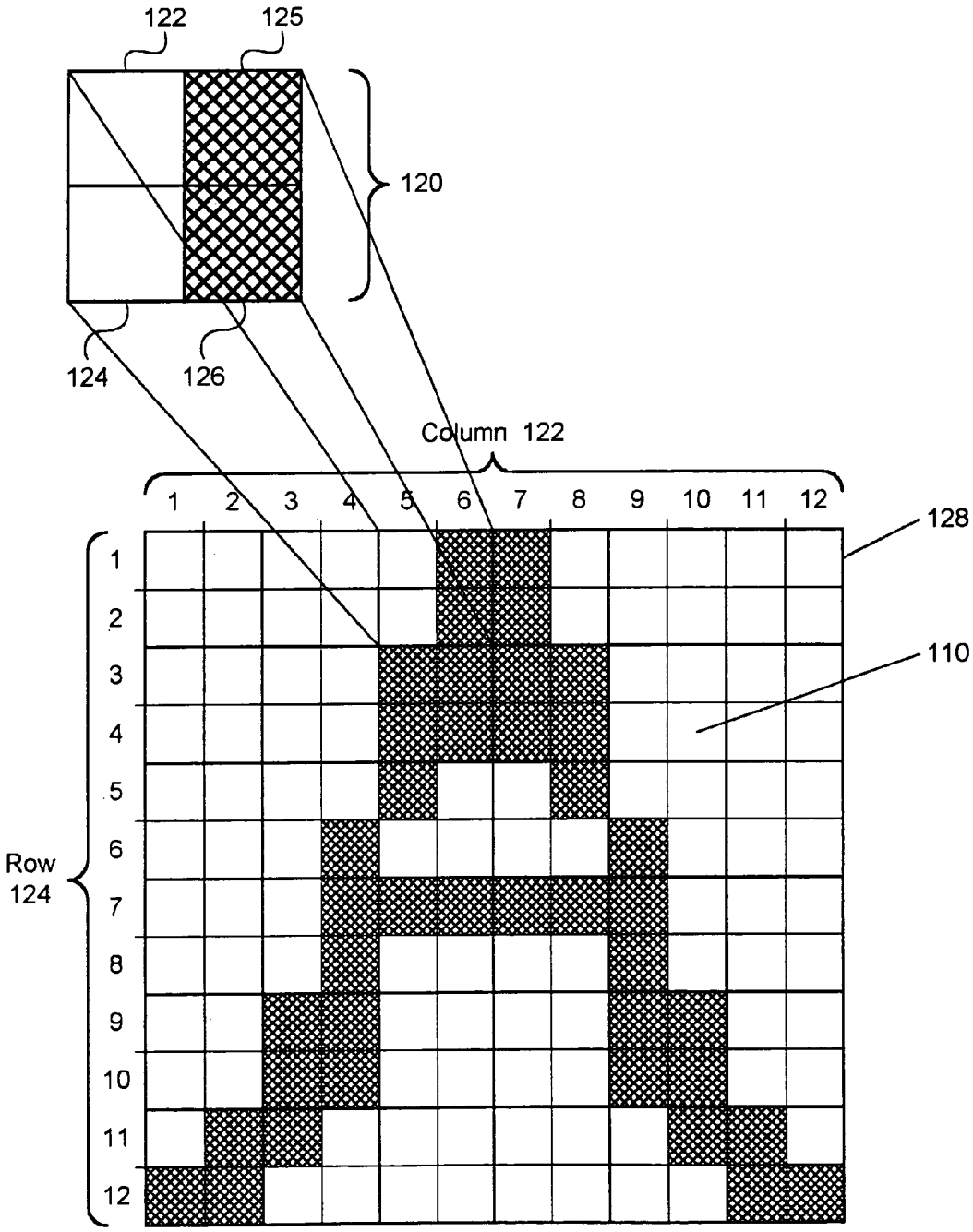
Figure 1D:
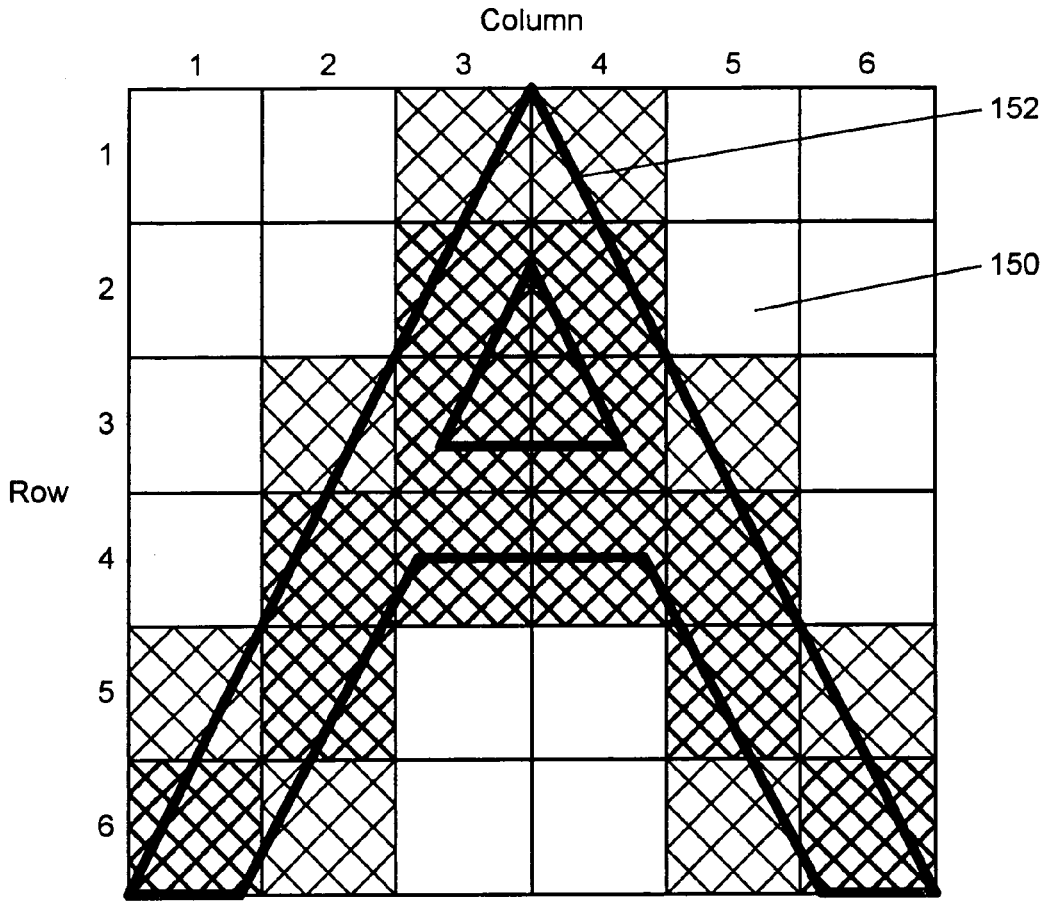

FIG. 1B shows a rendering of character 110, which corresponds to character 101, in a bit map having a number of bits greater than a number of pixels in a region of the display in which the character is to be displayed. Here, set of columns 122 has twice as many columns (1–12) as columns 142 (1–6) in the corresponding table 140 in FIG. 1C. Similarly, set of rows 124 (1–12) includes twice as many rows as rows 144 (1–6) of table 140. Entries of table 140 each are for a pixel. Thus, for each corresponding pixel, the bit map shown in FIG. 1B includes four bit values. For example, bits 120 (122, 124, 125, and 126) correspond to table entry 146 of table 140, and table entry 146 corresponds to a single pixel (pixel 152 of FIG. 1D).

A percentage value is calculated for each set of bits in the bit map 128 of FIG. 4 that corresponds to a pixel of the corresponding portion of the display in which the character is to be displayed. For example, among bits 120, bits 122 and 124 are on, and bits 125 and 126 are off. Thus, 50% of the bits are on, among bits 120. Therefore, the corresponding value 146 in table 140 is 50%. This value of 50% is then used to determine the luminance of the corresponding pixel 152, shown in FIG. 1D. For example, luminance of pixel 152 may be half of the luminance that would be used for a pixel corresponding to a portion of a shape that is fully covered by the shape.

According to one embodiment of the invention, in a set of 16 bits, the luminance is set to the maximum value when either 15 or 16 of the bits are on. According to various embodiments of the invention, various schemes are used to relate percentage of bits on to luminance. The percentage of bits on or off may be directly converted to a percentage of the maximum luminance. According to other embodiments of the invention, attributes other than luminance, such as hue or saturation, may be adjusted according to the corresponding bits in the bit map.

Various ratios between the number of bits in the bit map and number pixels in the corresponding set of pixels are possible. For example, according to one embodiment of the invention, the bit map has at least twice as many columns as columns in the corresponding set of pixels. According to another embodiment of the invention, the bit map has at least ten times as many columns as columns in the corresponding set of pixels. According to another embodiment of the invention, the bit map has a number of bits twice as great as the number of pixels in the corresponding set of pixels. According to another embodiment of the invention, the bit map has a number of bits ten times as great as the number of pixels in the corresponding set of pixels.

Figure 2:
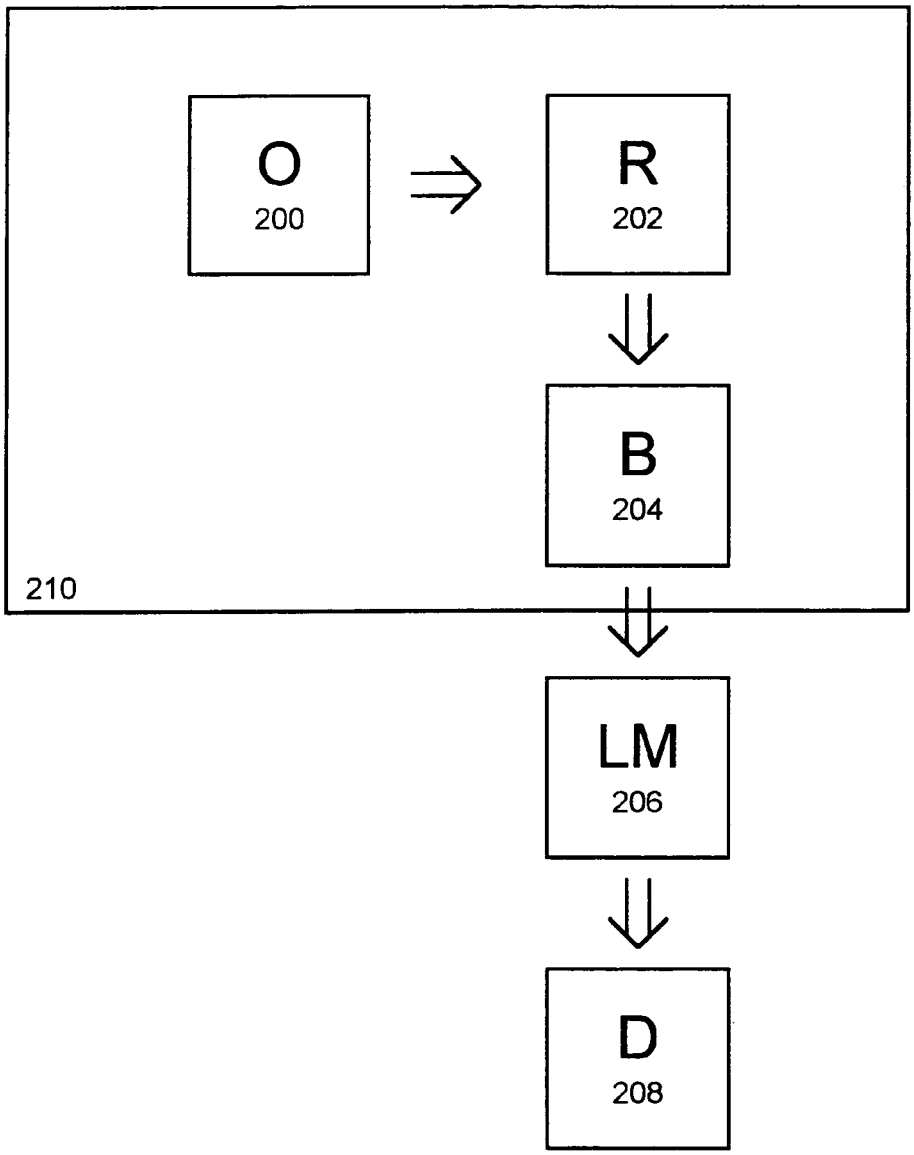
FIG. 2 is a block diagram of a system for displaying a character according to an embodiment of the invention.

FIG. 2 is a block diagram of a system for displaying a character according to an embodiment of the invention. The system includes an outline module 200, a rendering module 202, a bit map module 204, a luminance module 206, a luminance module 206, and a display module 208. Outline module 200 contains representations of the characters of a font. Such representations may be, for example, Adobe Type 1™ fonts or True Type fonts. According to another embodiment of the invention, the outline module includes information about other shapes other than fonts, such as geometric shapes. Rendering module 202 takes information from outline module 200 to render a representation of the corresponding shape of the font. In response, bit map module 204 creates a bit map. The bit map is a set of bits, which are on or off, according to the shape rendered by rendering module 202. The output of bit map module 204 is provided to luminance module 206, which determines luminances of pixels corresponding to respective sets of bits in the bit map. The result from luminance module 206 is displayed by display module 208.

Outline module 200, rendering module 202, and bit map module 204 may be part of graphics components 210, which, according to one embodiment of the invention, is not particularly adapted to be used with luminance module 206. The system causes graphics components 210 to yield a bit map of a size larger than what is to be displayed by display module 208. Luminance module 206 uses this larger bit map to determine luminances and then provides luminance values for respective pixels to display module 208 to allow the shape to be displayed in its proper size, with luminances to account for aliasing of the shape.

According to one embodiment of the invention, graphics components 210 are replaced by another system that produces a bit map corresponding to a shape. Graphics components 210 create the bit maps in a size larger than the size to be displayed. These larger bit maps are then used to determine pixel values and respective luminances of the pixels.

Figure 3:
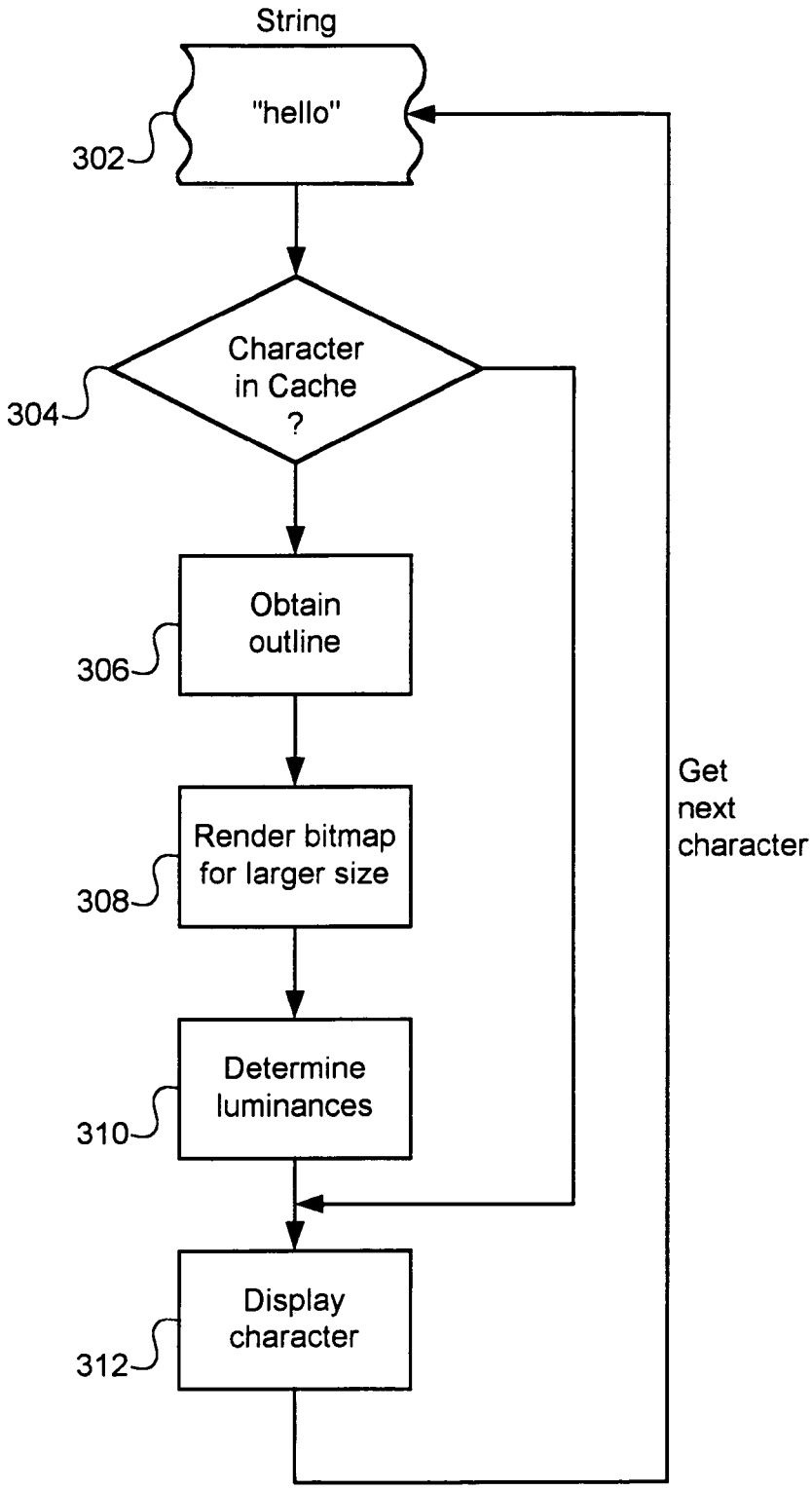
FIG. 3 shows a flow diagram of display of a character according to an embodiment of the invention.

FIG. 3 shows a flow diagram of display of a character according to an embodiment of the invention. The string "hello" 302 is displayed according to the method shown. Each character is processed. First, it is determined whether the character has already been processed and is available in a cache (block 304). If the character is available in the cache, then proceed to block 312 and display the character.

If the character is not in the cache, then obtain the outline of the character (block 306). This outline may be obtained, for example, from a module containing characters of a font such as Adobe Type 1™. Next, render a bit map for a size larger than the size of the character to be displayed (block 308).

Next, determine luminances of pixels corresponding to respective sets of bits in the bit map (block 310). Thus, luminances are used to help better depict a shape where the resolution in terms of number of pixels may be low. Varying the luminance helps to account for where the borders between pixels do not correspond exactly to the edges of the ideal form of the shape, or character, to be displayed. For example, as described above, a luminance of 50% of the full luminance may be used where only 50% of the ideal shape of the shape would cover the pixel. In an alternative embodiment of the invention, an attribute of the pixel other than luminance is adjusted in response to the corresponding set of bits in the bit map.

Finally, display the character with the pixels having the determined luminances (block 312). After displaying the character, get the next character and continue the process with that character and other characters in string 302.

Figure 4A:
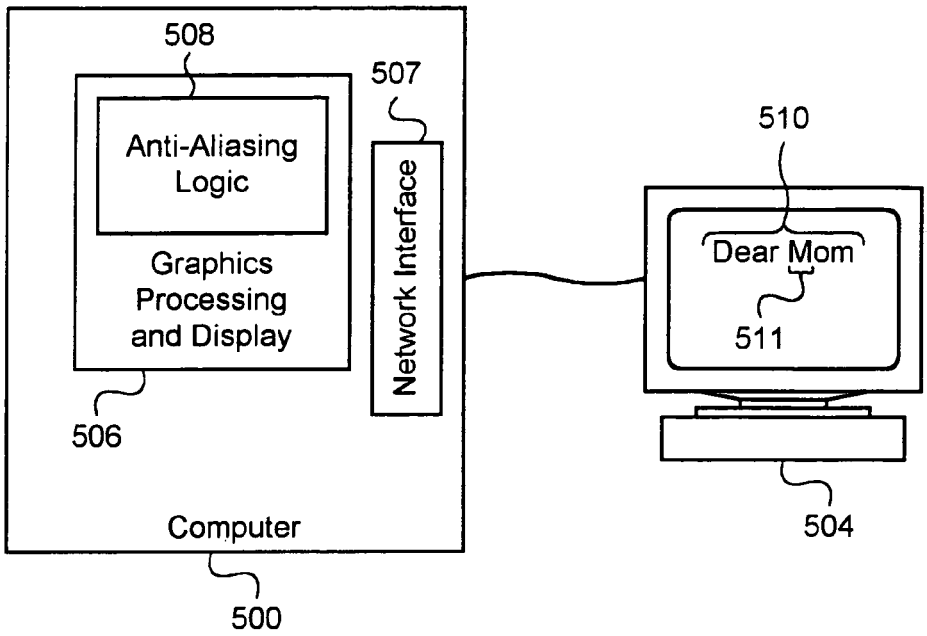
FIG. 4A shows a block diagram of a computer system according to an embodiment of the invention.

FIG. 4A shows a block diagram of a computer system according to an embodiment of the invention. Computer 500 is coupled to monitor 504. Computer 500 includes graphics processing and display module 506, which includes anti-aliasing logic 508. Computer 500 also includes Network Interface 507 to couple computer 500 to a network, such as the internet. For example, Network Interface 507 may allow computer 500 to be used to send e-mail. With the help of anti-aliasing logic 508, accordingly to an embodiment of the invention, text 510 is displayed on monitor 504. Text 510 includes character 511 ("M") of the string "Dear Mom 510." The character "M" 511, and other characters of the string 510, are displayed, according to an embodiment of the invention, using anti-aliasing logic 508. Anti-aliasing logic 508, according to an embodiment of the invention, determines luminances for pixels within character 511 based on a particular bit map. In this manner, according to an embodiment of the invention, an improved rendition of string 510 is achieved. An embodiment of the invention helps to better render shapes, such as characters, where the resolution of the display in terms of numbers in pixels per area is low, however, an attribute of the display may be varied to help better render the shape. The attribute may typically be luminance, such that luminance is made greater or lesser depending on the percentage of the corresponding area of the bit map that is covered by the shape. The attribute may another attribute such as hue, saturation, or other attribute.

Figure 4B:
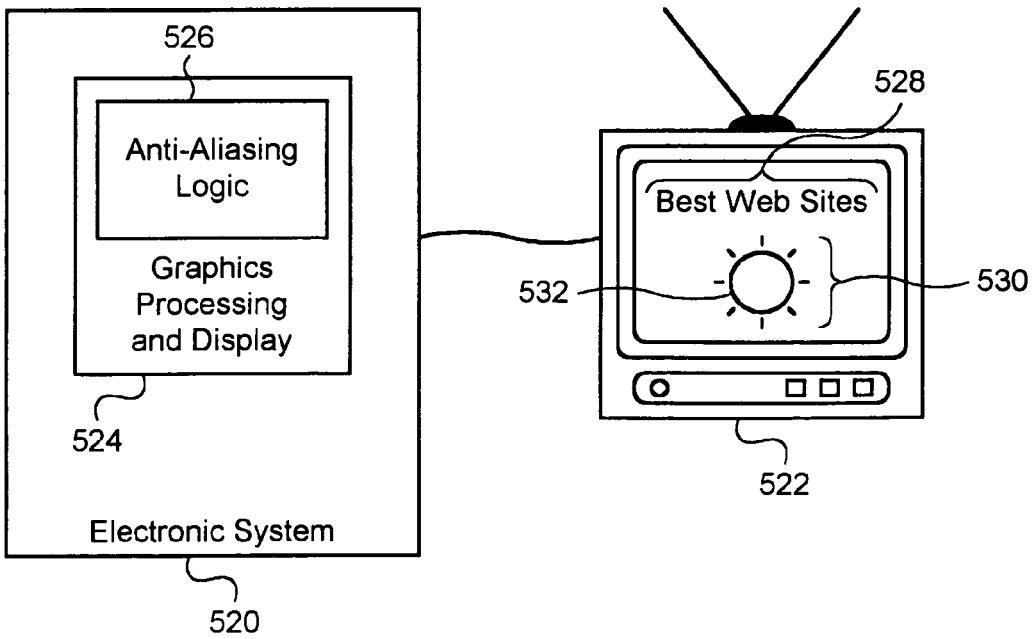
FIG. 4B shows a block diagram of a television system according to an embodiment of the invention.

FIG. 4B shows a block diagram of a television system according to an embodiment of the invention. Electronic system 520 is coupled to television 522. Electronic system 520 includes graphics processing and display 524, which includes anti-aliasing logic 526. Electronic system 520 helps to display string 528 and graphic 530 on television 522. Characters in string 528 ("Best Web Sites!") may be displayed using an anti-aliasing method according to an embodiment of the invention. For example, character "B" 529 may be determined as a bit map larger than the size at which character "B" 529 is to be displayed on television 522. Then, luminances of the corresponding pixels of character "B" 529 are determined based on the relative numbers of bits in the corresponding bit map that are on. Similarly, shape 530 may be displayed according to an embodiment of the invention. For example, circular curve 532 may be displayed as a series of pixels with luminances whose values are calculated based on a bit map larger than the shape 530 to be displayed on television 522. In this way, attributes, such as luminance, may be used to help compensate for a relatively low resolution of television 522 or other display device.

Figure 4C:
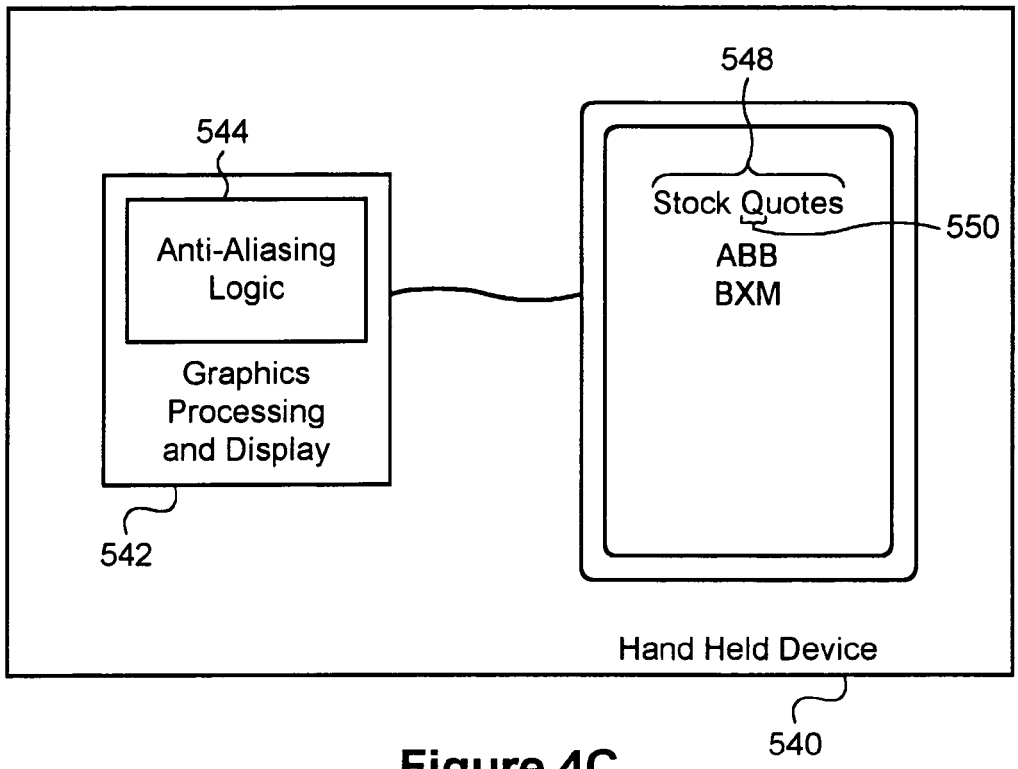
FIG. 4C shows a block diagram of a hand-held device according to an embodiment of the invention.

FIG. 4C shows a block diagram of a hand-held device according to an embodiment of the invention. Hand-held device 540 includes graphics processing and display 542 and display 546. Graphics processing and display 542 causes text 548 to be displayed on display 546, according to an embodiment of the invention. Graphics processing and display 542 includes anti-aliasing logic 544, which, according to an embodiment of the invention, helps to display shapes on display 546 through determining attributes of corresponding pixels of display with bit maps. Text 548 ("STOCK QUOTES ABB BXM") may be rendering according to an embodiment of the invention. For example, for character "Q" 550, first a bit map larger than character "Q" 550 may be determined, and then luminances of pixels corresponding to respective bits in the bit map are then calculated based on the percentage of the bits in the bit map that are on.

Various display devices, for example, a cathode ray tube, liquid crystal display, other light emitting or light reflecting display or other display may be used in combination with various information processing or electronic systems without departing from the spirit of the invention. For example, monitor 504, which is coupled to computer 500, may comprise of a cathode ray tube, liquid crystal display, flat panel display, or other display technology, according to various embodiments of the invention. Electronic system 520 may be integrated with television 522, or may take the form of a set top box. Computer system 500 may include optional network interface 506, which may be adapted for communication with the Internet or may be specifically adapted for use as a Web browser.

Figure 5:
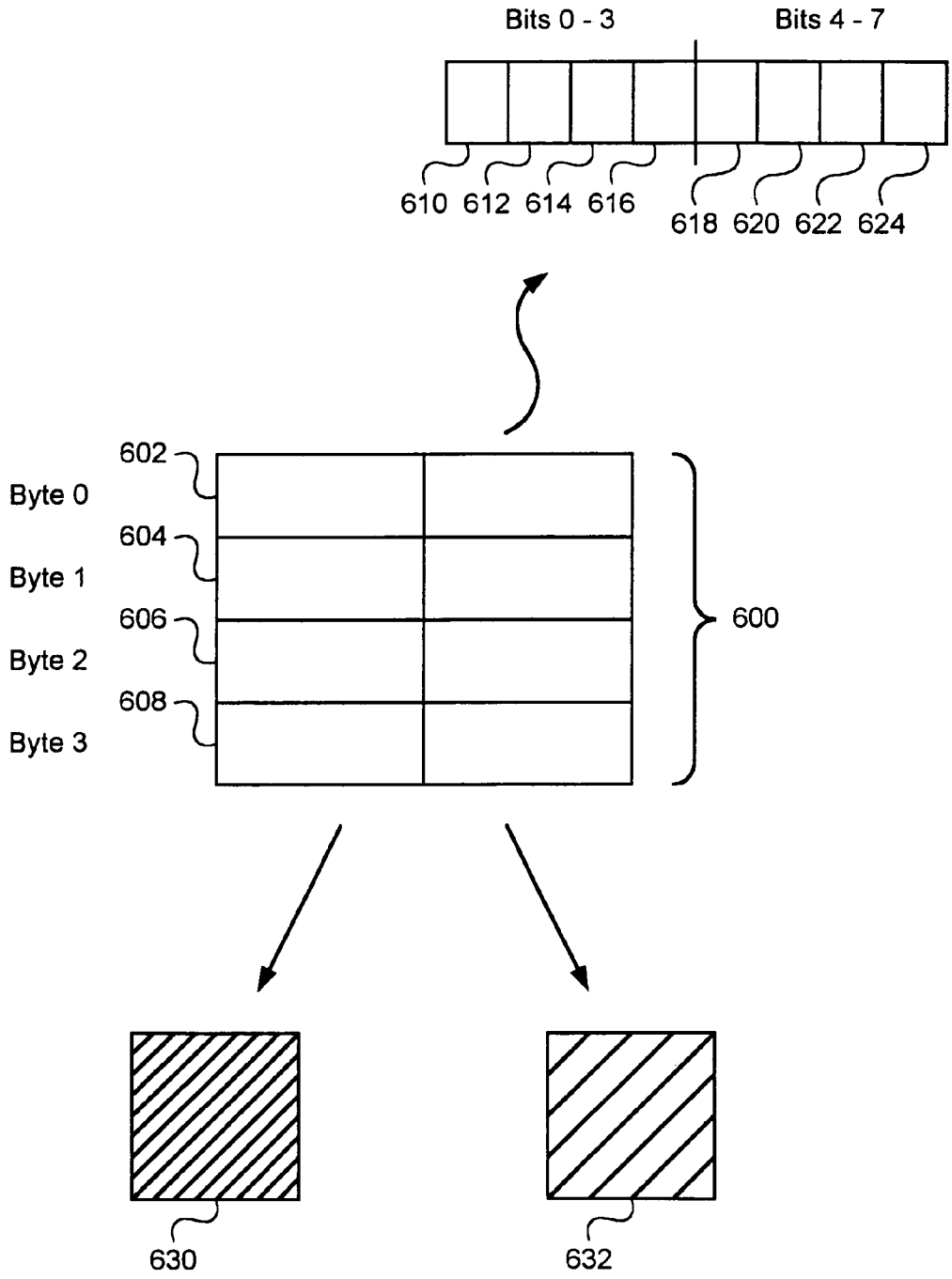
FIG. 5 shows a block diagram of a portion of a bit map and associated pixels according to the embodiment of the invention.

FIG. 5 shows a block diagram of a portion of a bit map and associated pixels according to an embodiment of the invention. Set of bits 600 of a bit map includes byte 0 602, byte 1 604, byte 2 606, and byte 3 608.

Set of bits 600 are processed so as to yield two pixels, each having a respective luminance that corresponds to a percentage of bits in respective set of bits. Here, pixels 630 corresponds to the low-order bits (0–3) of byte 0–byte 3 (i.e., 602, 604, 606, and 608), and pixel 632 corresponds to the high-order bits (bits 4–7) of byte 0–byte 3. As shown, byte 0 602 is comprised of low order bits 0–3 (610, 612, 614, and 616), and high-order bits 4–7 (618, 620, 622, and 624).

Figure 6:
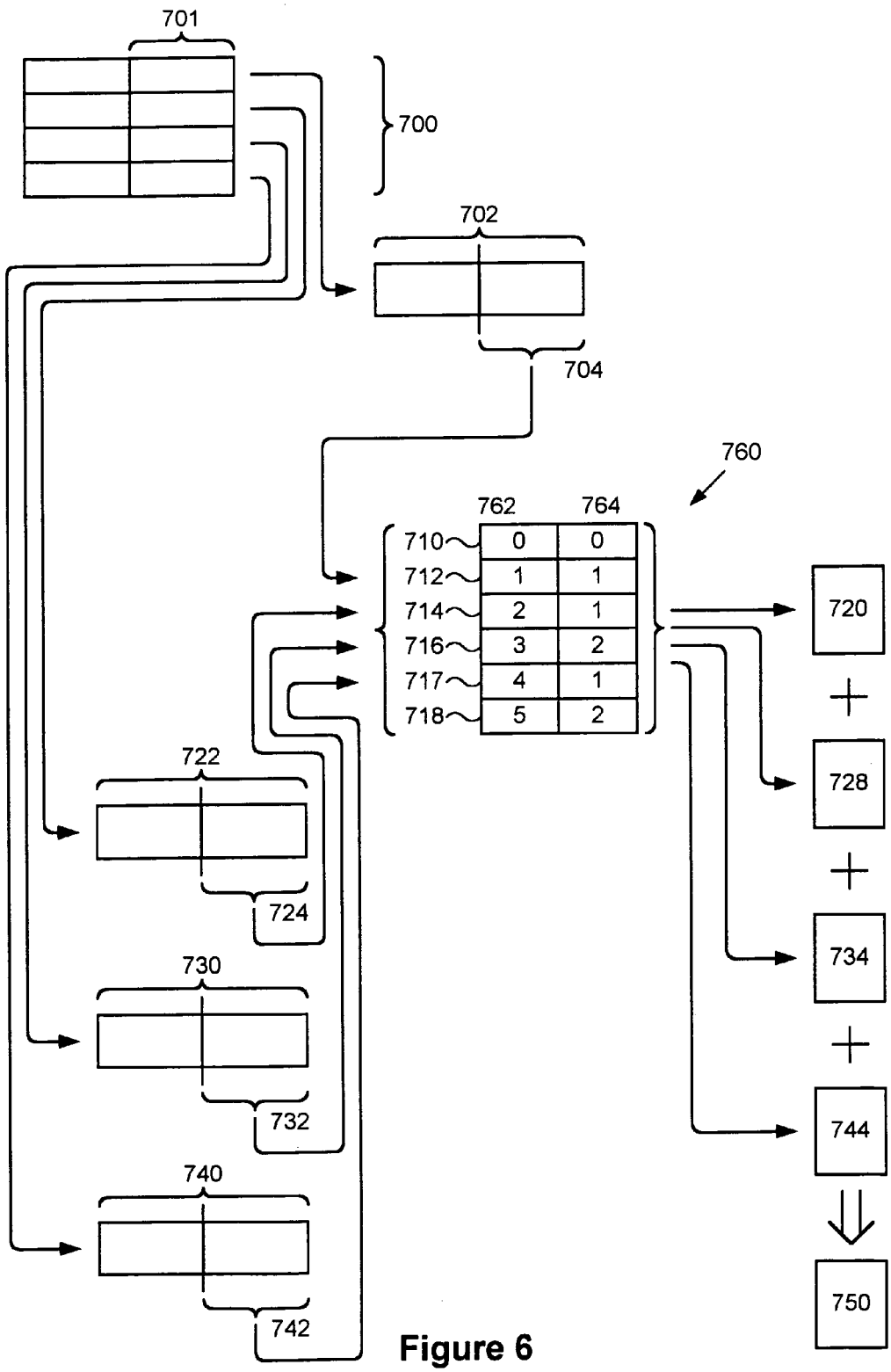
FIG. 6 shows a block diagram of a portion of a bit map and an associated pixel according to the embodiment of the invention.

FIG. 6 shows a block diagram of a portion of a bit map and a resulting pixel value according to the embodiment of the invention. Through the use of a table, the percentage of bits that are on in high-order bits 701 of set of bits 700 is calculated. For example, high-order bits 704 of byte 702 of set of bits 700 are used as an index into table 760. Column 762 of table 760 corresponds to possible values of high-order bits 704. These values have corresponding values in column 764, which indicate the number of bits that are on in such set of bits. For example, row 712 shows that when the bits 704 have the value "1," then a total of one bit is on. Similarly, row 718 shows that when bits 704 have the value "5," then the total number of bits that are on is 2. Thus, for high-order bits 704 of byte 702, a number is determined of the number of bits that are on. This number is represented as block 720. Similarly, for high-order bits 724 of byte 722, a number is calculated from table 760 (block 728). Similar calculations are made for high-order bits 732 of byte 730 and high-order bits 742 of byte 740, yielding numbers represented as respective blocks 734 and 744. These numbers (block 720, 728, 734, and 744) are added to yield a number (block 750) which represents the number of bits that are on in set of bits 701.

This number (block 750) relative to the total possible number of bits on in set of bits 701 is used to determine a luminance for the corresponding pixel. An advantage of this configuration that uses a table 760 is that the percentage of bits on in the bit map is calculated relatively rapidly.

Various embodiments of the invention have been illustrated in the figures and have been described in the corresponding text of this application. This foregoing description is not intended to limit the invention to the precise forms disclosed. Rather, the invention is to be construed to the full extent allowed by the following claims and their equivalents.

What is claimed is:

1. A method of displaying a set of characters, the method comprising:

in a system having a specific hardware display device that has a specific resolution, receiving a command to generate a character from the set of characters;

if the character has already been processed and is available in a cache, displaying the character;

if the character has not already been processed, taking the resolution of the hardware display device into consideration, determining a representation of a character in a bit map having a number of bits greater than a number of pixels in a region of the display device in which the character is to be displayed wherein various bits in a respective portion of the bit map corresponding to a pixel; and among the various bits that correspond to the pixel, different bits correspond to different locations on the character;

based on a percentage of bits that are on in respective portions of the bit map, determining luminance for corresponding pixels; and displaying the character in the region having the particular number of pixels, the pixels being displayed with the determined luminance.

* * * * *